United States Patent [19]

Midana

[11] 4,113,258

[45] Sep. 12, 1978

[54] GOLFER'S CLUB SWING AND STANCE TRAINING DEVICE

[76] Inventor: Fiorenzo Midana, Corso Giovanni Agnelli 48, Turin, Italy

[21] Appl. No.: 764,816

[22] Filed: Feb. 2, 1977

[30] Foreign Application Priority Data

Dec. 20, 1976 [IT] Italy ..... 53717/76[U]

[51] Int. Cl.[2] ..... A63B 69/36

[52] U.S. Cl. ..... 273/186 C; 273/187 A

[58] Field of Search ..... 273/187 A, 187 R, 183 A, 273/186 R, 186 C, 183 B, 183 E, 191 R, 192; 35/29 A

[56] References Cited

U.S. PATENT DOCUMENTS

| | | | |
|---|---|---|---|
| 2,707,638 | 5/1935 | Manley | 273/187 A |
| 3,300,219 | 1/1967 | Sipos | 273/187 R |
| 3,638,950 | 2/1972 | Hyotlaine | 273/187 R |
| 3,860,247 | 1/1975 | Taylor | 273/187 A X |

*Primary Examiner*—George J. Marlo

[57] ABSTRACT

A didactic device for golf playing exercises, comprising a plate of cardboard or the like with recesses defined by upstanding rims for insertion of the feet of the player to keep him in the best stance and parallel lines indicating the correct position of the golf club for carrying out the swing. When used indoors, the device may be anchored to the indoor carpeting by using a special fastening strip. The fastening strip includes a snap fastener button at one end, which will fit into a golf tee receiving hole provided in the device, and loop-type fiber fasteners (such as "Velcro") at the other end, which fasteners interlock with the carpet pile.

5 Claims, 3 Drawing Figures

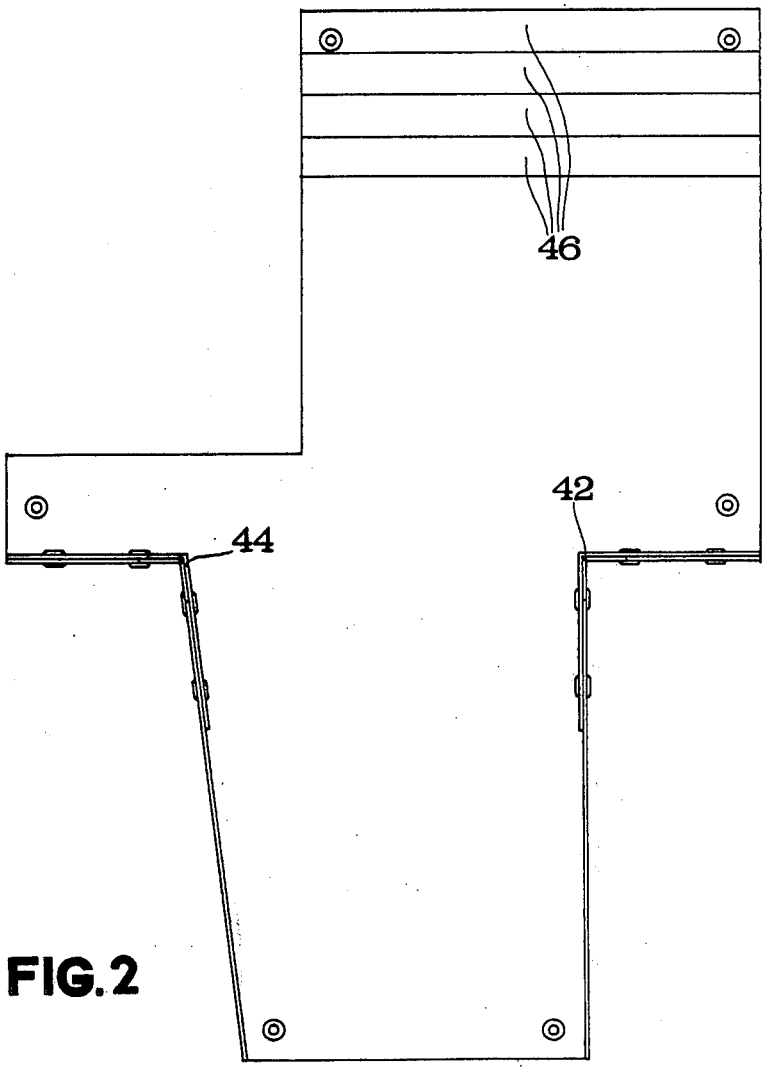
FIG. 2
FIG. 3
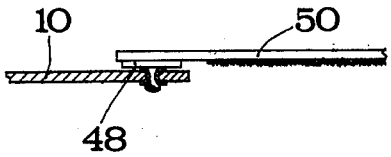

GOLFER'S CLUB SWING AND STANCE TRAINING DEVICE

This invention relates to a didactic device for golf playing exercises both on the golf course and in closed rooms such as homes. More particularly, this device is intended for learning how to drive a golf ball into the hole, the so-called "putting".

As is known, in golf playing for each hole one or more shots are required for moving the ball from far away to a mown grass area, the so-called "green", where the hole is located, whereafter one or more shots follow for driving the ball into the hole, the so-called "putting", which is carried out with a different technique and clubs different from those used for the shots of approaching the green. It may be said generally that putting involves about half the total number of shots of a match. This shows with great evidence the critical importance of the degree of training of a golf player in putting.

As in many other sports such as, for example, tennis, also and especially in golf playing the performance of a player depends on the accuracy with which he is able to control his muscles and on the degree of perfection with which the playing operations are carried out. This holds true particularly for putting and it can generally be said that the performance of a player depends essentially on the degree of perfection with which he has learned the correct positions and movements of each single muscle of the body required for carrying out a shot, so that he will instinctively assume the correct positions and make the correct movements. Particularly important in putting is the position of the player's feet relative to the ball, the alignment of the feet and their distance from the ball, the degree of spreading of the legs, the degree of slackness of the knees, the inclination of the chest, the degree of bending of the arms, etc. (the so-called "stance").

Just as important is the correct execution of the so-called "swing" , i.e. the succession of momentary positions of each part of the body and consequently of the head of the club that hits the ball, when the club is in effect moved toward the ball. All these complex muscle controlling movements both in the stationary position or stance and in the subsequent dynamic phase or swing must, of course, be consciously and analytically be learned and studied before they can become instinctive as mentioned above.

It is therefore an object of the present invention to provide a didactic device for putting exercises, having guides or visible boundaries adapted to show the player immediately any defect or error both in the stance and swing. This object is achieved by the present invention by a device which is simple and economical to produce.

These and other objects and advantages which will appear from the following description are achieved according to the invention by a didactic device for putting exercises, which comprises a substantially flat plate of irregular polygonal shape, having at least one first and second converging sides, a third and a fourth side extending colinearly from the diverging ends of said first and second sides and perpendicularly of said first side toward the outside, said first and second sides defining positioning contours for the tip and the inner side of the right foot of the user, respectively, and the second and fourth sides defining positioning contours for the tip and inner side of the left foot of the user, respectively, said plate further comprising at least one straight reference line extending parallel to said third and fourth sides at a predetermined distance therefrom.

A preferred embodiment of the invention will now be described by way of example and with reference to the accompanying drawings, in which:

FIG. 2 is a top plan view of the device made of the cardboard blank of FIG. 1, and FIG. 3 is a part sectional view of the device as provided with a member for anchoring it to the ground.

Figure 1:
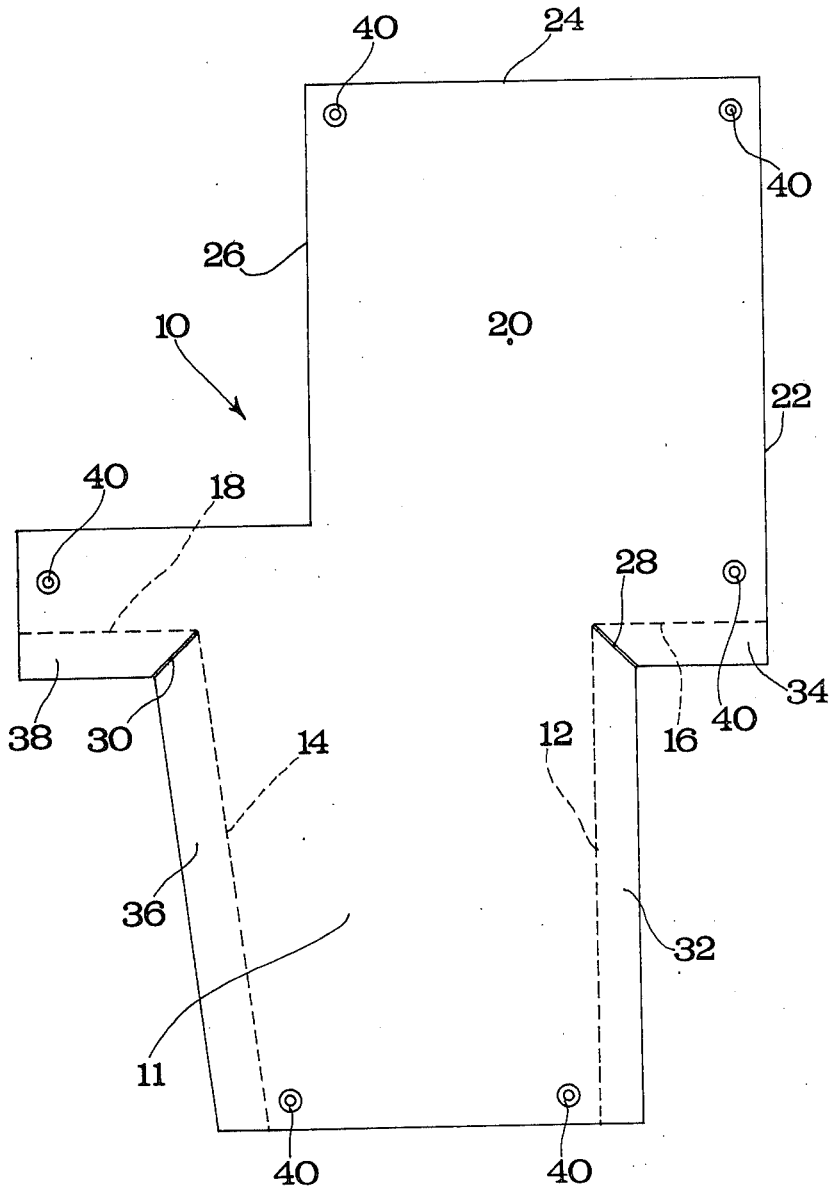
FIG. 1 is a top plan view of a cardboard blank for forming the device of the present invention.

Referring to FIG. 1 there is shown a blank made of a sheet of rigid cardboard and having an irregular polygonal shape. The blank 10 has a central area 11 defined by two sides 12 and 14 which are not parallel to one another and converge toward a free end, diverging toward the other end. Two further sides 16 and 18 extend from the divergent ends perpendicularly of the side 12 colinearly toward the outside. The blank 10 further comprises a substantially rectangular area 20 defined by sides 22, 24, 26 with the side 24 extending parallel to the colinear sides 16 and 18.

Outwardly of the adjacent sides 12, 16 and 14, 18, respectively, the blank 10 has an edge formed integrally with the sheet of cardboard and in this integral edge cuts 28, 30 are made to form folding edges 32, 34, 36, 38 for which the sides 12, 14, 16, 18 form the folding lines.

The cardboard blank 10 is further provided with a plurality of small punched holes 40 distributed along the periphery thereof.

FIG. 2 shows the finished device obtained by folding the edges 32, 34, 36 and 38 of the blank 10 at right angles and sewing or fixing the position of these bent edges with the aid of auxiliary cardboard members 42, 44 secured to the edges by rivets or the like. The holes 40 are provided with metal reinforcing rings.

In a preferred embodiment the medium distance between the sides 12 and 14 of the device is about 18–19 cm while the angle formed by the side 14 relative to the direction of the side 12 is about 5°–8° although these measures may vary around these medium values. The distance of the far side 24 of the rectangular area 20 from the straight line defined by the sides 16, 18 preferably is about 26 cm. At intervals of about 2 cm from the side 24, the rectangular area 20 is further provided with one or more parallel lines 46, preferably obtained by different colours of the spaces defined thereby.

The described device is used in the following manner:

With the device placed on the ground the player initially sets his right foot in the recess formed by the sides 12 and 16 so that the tip of the foot will engage the edge 34 while the inner side of the foot engages the edge 32. The left foot is set with its tip against the edge 38 and its inner side against the edge 36. In this condition the player then has to find the most natural posture according to criteria well known to golf players and select and grip the club which by its dimensions and inclination is most suitable for his physical structure. The device is so dimensioned and the position and number of the reference lines 46 are such that each player will find a reference line 46 on which the head of the club will be located in the position of preparation for the shot. For this purpose a reference line may be traced on or cut into the club head in an ideal extension of the reference line marked on the device, as viewed by the player.

Once the best position (in connection with the most suitable club) has thus been determined, the player can resume each time exactly the same position by setting his feet against the device and aligning the club head with the reference lines on the device, thus training his muscles to gradually assume, as by instinct, the correct stance.

With the device of the present invention the player may then exercise himself in effectively carrying out the shot. After having aligned the selected reference line 46 with the direction of the hole, the player hits the ball by making the known swinging movement prescribed by golf playing rules, making an effort to keep the club head constantly aligned with the predetermined reference line 46. Initially this movement can be carried out slowly, but as it is repeated again and again and the player gets used to it, it may be carried out with ever increasing speed and accuracy so that also in this case it becomes the player's "second instinct". Each time the player maintains the alignment between the reference lines on the club and the device during his movements the ball will be sure to hit the hole.

The holes 40 permit the player to fix the device to the ground by pins, preferably of the type of a so-called "tee" commonly used in golf playing as a support for the ball and therefore easily available for any golf player.

The device may also be used outside the golf course, for example, in a room of a home provided that it is sufficiently large. Preferably the room should be paved with tiles or laid out with carpets of the moquette type. The hole may then be replaced by some target that is placed on the floor while the device is placed and secured to the floor by means such as adhesive tape or the like. FIG. 3 shows an anchoring device comprising a button 48 for insertion in snap fastener fashion in one of the holes 40. From the button 48 extends a flexible tab 50, for example, in the form of a band of Velcro (trademark) which can be removably attached to most types of moquette and the like. By using a plurality of anchoring devices of this type, one for each of several of the holes 40, the device can thus be secured in position in a closed room, too.

By way of example some indicative measures have been given which on an average are considered to be best for the present device, but obviously these measures may vary within certain limits, particularly if the device is intended to be used by persons whose anthropometrical measures differ greatly from those that are most common. Further, although hereinbefore an embodiment of the device has been described which is made almost completely of cardboard, it will be understood that the device may also be made of other materials such as plastic or the like material.

The surface of the device on which there are no reference lines 46, particularly the trapezoidal surface 11 between the sides 12 and 14, may preferably be used for application thereto of a table containing some brief instructions for use of the device.

I claim:

1. A golfer's stance training device comprising a substantially flat member including first and second areas integrally connected at and extending respectively in opposite directions longitudinally from approximately the mid-region of the member, a plurality of longitudinally spaced laterally extending reference lines on said first area, a first longitudinally extending edge defining one side of said second area disposed substantially perpendicular to the transverse center line of the member, a second generally longitudinally extending edge spaced laterally from said first edge and diverging in relation thereto in the direction of said transverse center line defining the other side of said second area, third and fourth edges being provided extending parallel to the transverse center line of the member beginning at the juncture thereof with said first and second edges respectively and extending laterally outwardly therefrom, and a terminal edge of the member extending between said first and second edges to define one end of the member, said second area defining a stance position such that the golfer standing astride said second area implanting his feet in a selected position such that the insteps respectively are adjacent said first and second edges and the toes of the shoes adjacent said third and fourth edges, and places the club to coincide with a selected one of the reference lines of said first area, whereby a natural free arrangement of the feet, body and hands is obtained while controlling the swing of the club.

2. A device as claimed in claim 1, wherein said first, second, third and fourth edges are provided with upstanding reinforcing rims.

3. A device as claimed in claim 1, wherein holes are provided in the device near the periphery thereof for the application of fixing means such as pins and tees.

4. A device as claimed in claim 3, including a snap fastener button insertable in one of said holes and a band integrally connected to said button having thereon loop-type fiber fastening means.

5. A device according to claim 1, wherein the angle formed by said first and second sides is from 5° – 8°.

* * * * *